United States Patent [19]

Sherman et al.

[11] 4,404,955

[45] Sep. 20, 1983

[54] FIREPLACE HEAT EXTRACTOR

[75] Inventors: William P. Sherman, Portland; Floyd R. Clark, Scappoose, both of Oreg.; Lothar K. Will, Sparta, Tenn.

[73] Assignee: Thomas Industries Inc., Louisville, Ky.

[21] Appl. No.: 294,614

[22] Filed: Aug. 20, 1981

[51] Int. Cl.[3] ..... F24B 7/00

[52] U.S. Cl. ..... 126/121; 126/131; 126/164

[58] Field of Search ..... 237/51; 126/121, 131–133, 126/164, 143, 61, 63, 66, 67, 77, 288, 289, 290, 298, 120

[56] References Cited

U.S. PATENT DOCUMENTS

| | | | |
|---|---|---|---|
| 3,096,754 | 7/1963 | Howrey | 126/121 |
| 3,190,282 | 6/1965 | Bauer | 126/131 |
| 3,995,611 | 12/1976 | Nelson | 126/121 |
| 4,008,706 | 2/1977 | Buanno | 126/121 |
| 4,010,729 | 3/1977 | Egli | 126/121 |
| 4,096,849 | 6/1978 | Moncrieff-Yeates | 126/121 |
| 4,136,662 | 1/1979 | Willson | 126/61 |
| 4,184,473 | 1/1980 | McIntire et al. | 126/77 |
| 4,228,784 | 10/1980 | Malafouris | 126/121 |
| 4,240,401 | 12/1980 | Chesnut et al. | 126/121 |
| 4,258,879 | 3/1981 | Nischwitz | 237/51 |
| 4,271,814 | 6/1981 | Lister | 126/121 |

*Primary Examiner*—Lee E. Barrett

*Attorney, Agent, or Firm*—Emrich & Lee and Brown, Hill, Dithmar, Stotland, Stratman & Levy

[57] ABSTRACT

Disclosed is a forced-air heat extractor for use in a conventional fireplace. The heat extractor includes a plenum through which air is circulated by means of a blower which is positioned in an inlet duct connected to the plenum and located in the fireplace. The plenum is provided with a temperature responsive relief closure in its top wall which opens to permit the free flow of heated air upward toward the fireplace's flue in the event the temperature in the plenum exceeds a predetermined value, as might occur in the event of an interruption in the flow of forced air through the plenum, thus protecting the blower motor and associated circuitry from excessive temperatures. A bottom bar having an air inlet to which is coupled the inlet duct is positioned on the forward, lower portion of the fireplace. Upon this bottom bar a firescreen may be conveniently positioned. An outlet duct similarly couples heated air in the plenum to an air outlet in the bottom bar. Air flow control means positioned in the outlet duct is controlled by the blower-initiated air flow to permit air heated in the plenum to be transmitted through the outlet duct while preventing room air from being vented through the temperature-responsive releif closure when air is not forced through the heat extractor. Also provided is a grate having a rear trough and an inclined forward support which directs the combustible material such as roll logs placed thereon under gravity downwardly and rearwardly toward the rear trough where combustion occurs at a desired spacing from the plenum's front wall.

20 Claims, 7 Drawing Figures

FIG. 1
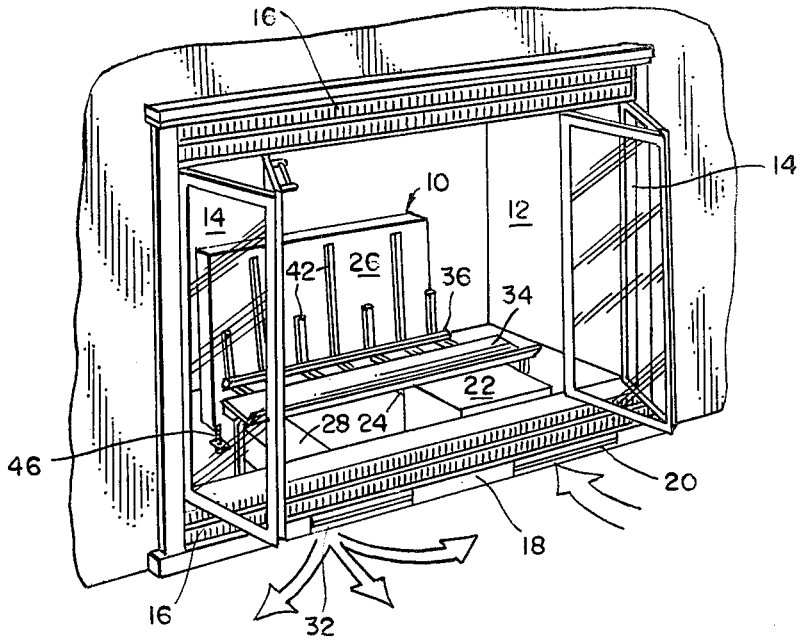
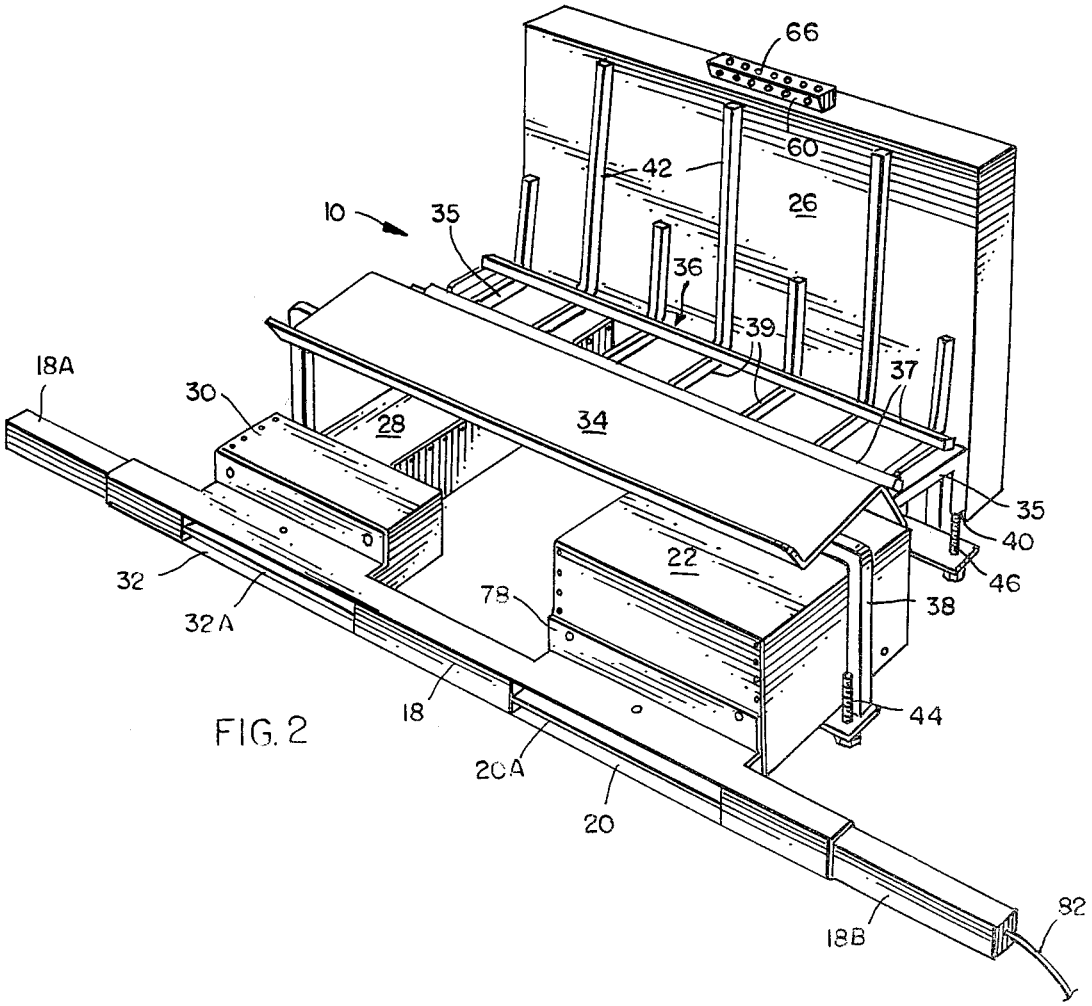
FIG. 2

FIG. 5
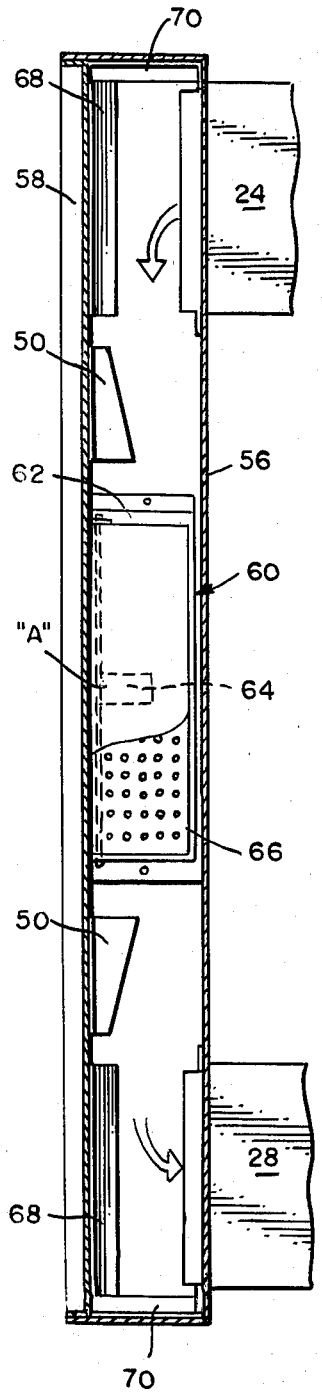
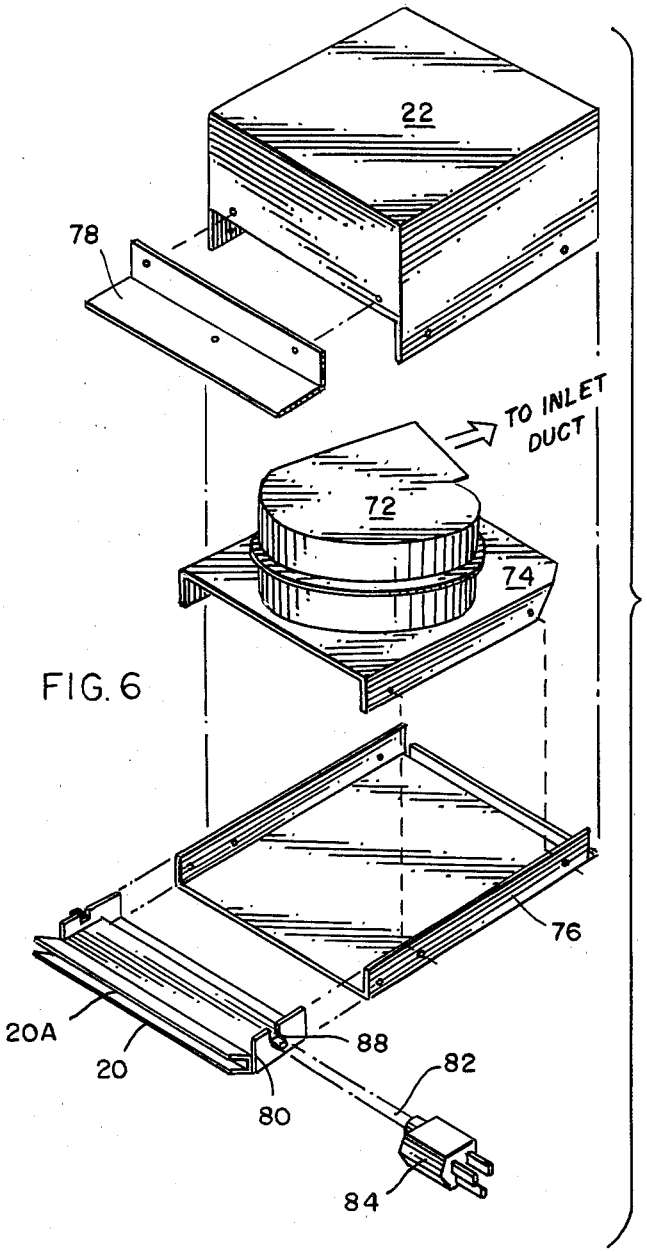
FIG. 6
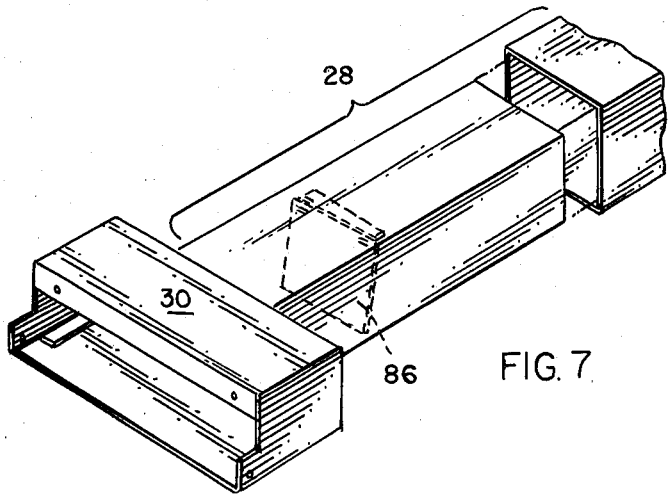
FIG. 7

FIREPLACE HEAT EXTRACTOR

BACKGROUND OF THE INVENTION

This invention relates generally to fireplace heaters and particularly relates to an improved forced-air fireplace heat exchanger capable of being positioned entirely within the fireplace.

A fireplace heat exchanger is a device placed in a fireplace for the purpose of extracting heat therefrom during combustion and providing heated air to adjacent areas. The extent to which such systems are capable of distributing heat depends primarily upon the rate at which air is circulated through the fireplace and the efficiency of heat transfer to the transported air in the fireplace. The prior art discloses various approaches for enhancing the heat transfer function such as extending the path of the moving air through the fireplace by means of extensive duct systems. One such approach is described in U.S. Pat. No. 3,190,282 to Bauer which makes use of an L-shaped structure having a horizontal portion which is placed on the floor of the fireplace and a vertical section which is positioned adjacent the fireplace's rear wall. Cold air is provided through an aperture to the vertical section which contains a duct system in which the air is circulated and heated. The heated air is then provided to the horizontal section from which it is forced out by means of convention into the adjacent area.

Another approach to a circulating air fireplace heat exchanger is disclosed in U.S. Pat. No. 4,096,849 to Moncrieff-Yeates wherein is described a fireplace unit having an inlet duct at the bottom of the fireplace, a vertical duct at the rear of the fireplace and an outlet duct near the top of the fireplace which is positioned over the area of combustion. The various ducts are angled with respect to the horizontal such that the heated air is always moving in an upward direction, thus providing for a self-circulating system which takes advantage of the rising effect of heated air. More recent attempts to further increase the heat extracted from a fireplace have made use of a source of forced air which is circulated through the fireplace thus providing for an increased volume of heated air. One such approach is described in U.S. Pat. No. 4,008,706 to Buanno in which air is circulated by means of a blower which projects the moving air along a baffle-deflected path through a housing which is positioned on the floor of the fireplace. The hot air exits the housing by means of an outlet positioned at the front of the housing for delivery to the area immediately adjacent to the fireplace. Another forced-air heating fireplace grate is disclosed in U.S. Pat. No. 4,010,729 to Egli wherein air is also forced into an inlet duct by means of a blower. An exhaust duct is coupled to the inlet duct by means of cross ducts through which the air flows while being heated by combustible materials resting primarily on the cross ducts. In these two patents the blower is positioned outside of the fireplace proper which is characteristic of prior art forced-air fireplace heat extraction systems.

It is desirable to position the heat extraction system entirely within the fireplace, not only to enhance aesthetic appeal, but also to reduce noise levels in the adjoining room produced by blower operation. Placing the entire heat extraction system in the fireplace subjects the blower mechanism and associated circuitry to extreme environmental conditions. This is particularly true where the heat extractor is utilized with a radiating type of firescreen which is typically equipped with glass doors. Heat buildup in the fireplace due to the positioning of the firescreen is substantially increased and, if the air flow through the heat extractor is interrupted, will likely destroy or substantially damage the blower and associated components.

SUMMARY OF THE INVENTION

Accordingly, it is an object of the present invention to provide an improved heat extraction system for use in a conventional fireplace.

It is another object of the present invention to provide an improved forced-air heat extraction system capable of being positioned entirely within a conventional fireplace.

Still another object of the present invention is to provide a forced-air fireplace heat extraction system with improved reliability.

A still further object of the present invention is to provide a forced-air fireplace heat exchanger with improved heat transfer characteristics and reduced heat loss properties.

The foregoing objects and features of the present invention are achieved by means of a forced-air heat extraction system for use in a conventional fireplace. The heat extraction system includes an input duct coupled to an exhaust duct by means of a plenum through which air is circulated by means of a blower located in the input duct. The plenum is provided with a temperature responsive relief closure in its top surface which opens for venting hot air in the plenum directly into the stack when the temperature therein exceeds a predetermined value, as when the blower shuts off. A sail plate valve blocks the reverse flow of air in the outlet duct and cooperates with the opening of the temperature responsive relief closure in directing air convection currents under these conditions to flow through the inlet duct and motor housing. This provides for the thermal protection of the blower motor and associated components. The components of the system are adjustable permitting it to be utilized in fireplaces of various widths and depths.

A section grate is positioned immediately adjacent the forward surface of the plenum for enhanced heat exchange.

The forward section of the grate includes a downwardly and rearwardly inclined plate located above the blower housing which serves not only as the heat shield for the blower but also deflects combustible materials onto the rear section of the grate for combustion thereon. Internal plenum baffling enhances heat exchange by directing the forced room air uniformly across the forward heat-exchange surface of the plenum.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is an isometric view of the heat extraction system of the present invention positioned in a conventional fireplace having a firescreen with glass doors;

FIG. 2 is a perspective view of a fireplace heat extractor in accordance with the present invention;

FIG. 5 is a sectional top view of the plenum and the inlet and exhaust ducts of the fireplace heat extractor of the present invention;

FIG. 6 shows an exploded view of the air circulator and associated housing; and

FIG. 7 shows the telescoping nature of the exhaust duct to which is connected the exhaust housing and in which is positioned the air flow control valve.

DETAILED DESCRIPTION OF THE PREFERRED EMBODIMENTS

Figure 4:
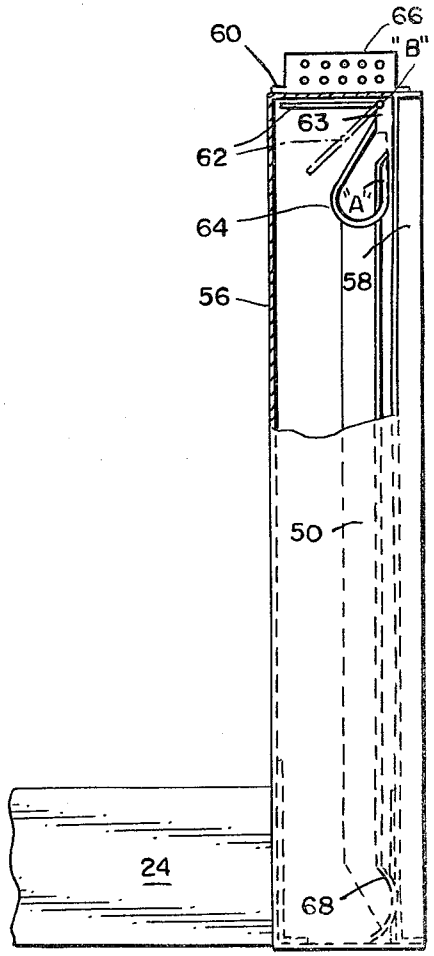
FIG. 4 is a partially cut away side view of the plenum and inlet duct assembly of the present invention.

Referring to FIGS. 1 and 2, a preferred embodiment of the fireplace heat extractor 10 of the present invention is shown. Room air is drawn into fireplace heat extractor 10 through air inlet 20 by means of an air circulator in housing 22 and is directed via inlet duct 24 into plenum 26 where the air is circulated. Plenum 26 is positioned in close proximity to rear grate section 36 upon which combustion primarily occurs resulting in the heating of the circulated air. An exhaust duct 28 provides an exit for the forced air from plenum 26 to air outlet 32 where it re-enters the room in which fireplace 12 is located. A forward grate section 34 is positioned adjacent rear grate section 36 and above air circulator housing 22 in providing a means by which combustible materials are provided as needed to rear grate section 36 for combustion thereon and in acting as a thermal barrier for the air circulator device.

In accordance with the fireplace heat extractor 10 of the present invention, a bottom bar 18 is located in the forward, lower portion thereof. Bottom bar 18 is positioned on the forward, lower threshold of fireplace 12 so as to extend completely thereacross while supporting a firescreen frame 16, if the fireplace is provided with a firescreen. Bottom bar 18 includes telescoping sections **18*a* and 18*b* which permit fireplace heat extractor 10 to be positioned in and utilized with fireplaces of various dimensions. As shown in FIG. 1, firescreen frame 16 supports firescreen doors 14** in a conventional manner.

Bottom bar 18 is also provided with an air inlet section 20 and an air exhaust section 32. Air is drawn in through air inlet 20 into fireplace heat extractor 10 and is forced out through air exhaust section 32 in a manner to be presently explained. Air inlet 20 and outlet 32 are provided with louvered apertures **20*a* and 32*a*, respectively, for providing directed air flow in the room in which fireplace 12 is located. In the preferred embodiment of the present invention louvers 20*a* and 32*a*** are positioned at an angle of 30°–35° to the horizontal for optimum air circulation.

Room air is drawn through air inlet 20 by means of an air circulator 72, shown in FIG. 6, which is positioned in air circulator upper housing 22 which is connected by means of air inlet upper housing 78 and air inlet lower housing 80 to air inlet 20. Air circulator 72, which typically may be a centrifugal blower, is electrically energized by means of electrical lead 82 which for aesthetic and safety reasons is positioned in bottom bar 18 and associated extension section **18*b*. Electrical lead 82 terminates in upper housing 22 with the air circulator, which hereinafter will be referred to as blower 72**.

Figure 3:
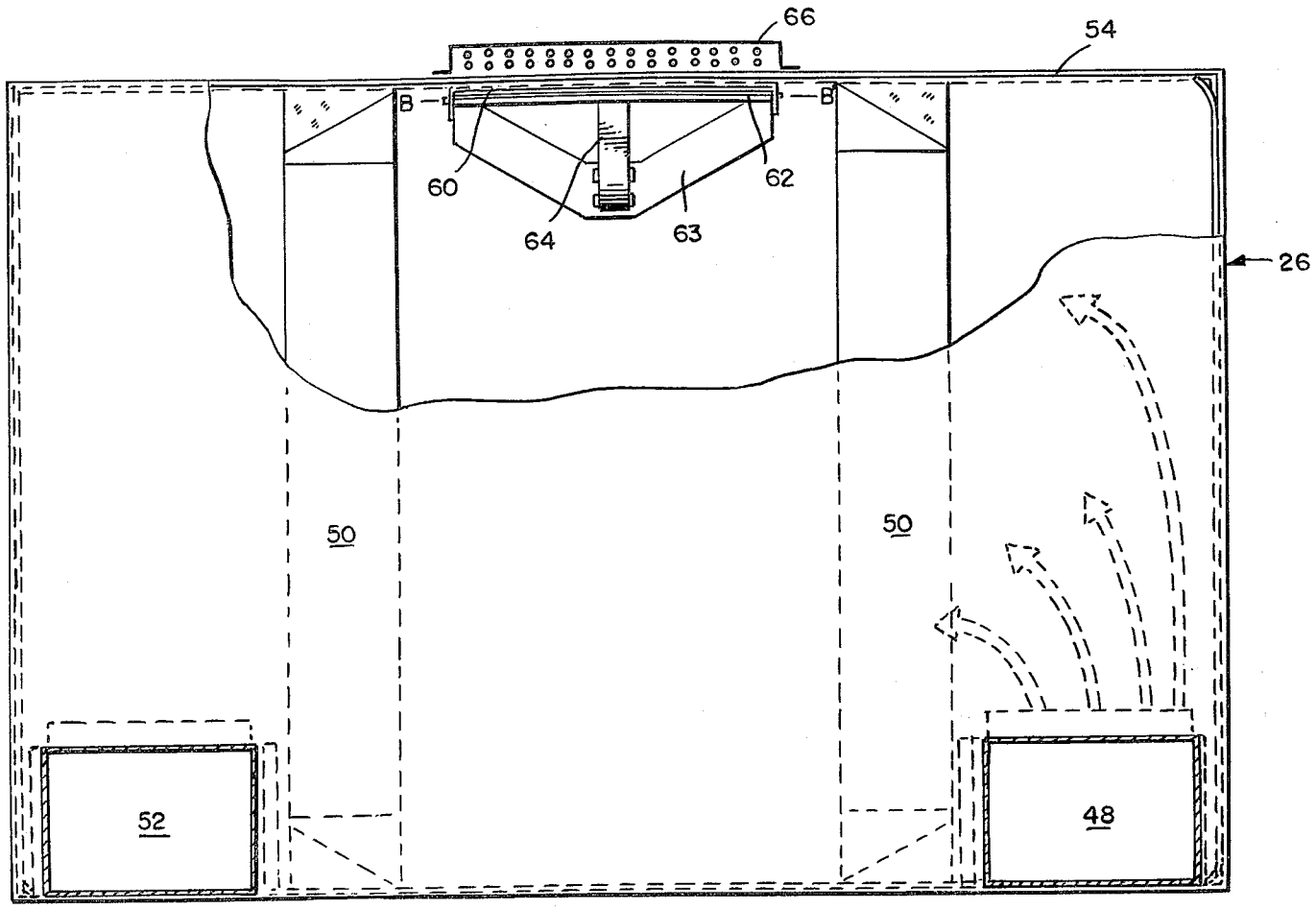
FIG. 3 is a partially cut away front view of the plenum of the fireplace heat extractor.

Air circulator, or blower, upper housing 22 is coupled to and directs the forced air into inlet duct 24 by means of which the forced air is introduced into plenum 26 through inlet duct aperture 48 as shown in FIG. 3. Plenum 26 is adapted for receiving the forced air which is circulated therein prior to its exit from plenum 26 into exhaust duct 28 via exhaust duct aperture 52. It is to be noted that while inlet duct 24 and outlet duct 28 are located adjacent the right and left portions, respectively, of plenum 26 when viewed from the front, the present invention is not limited to such a configuration in that these air ducts and associated components may be interchanged without affecting the performance of fireplace heat extractor 10. Positioned immediately adjacent the front wall 56 of plenum 26 is rear grate section 36 which includes lengthwise members 37 and crosswise members 39 which support the combustible materials during the combustion process. Crosswise members 39 include vertical extension sections 42 which are positioned between the combustible materials and the front wall 56 of plenum 26 for optimum heat transfer to the circulating air. Positioned immediately forward of rear grate section 36 is forward grate section 34 which is a solid member positioned immediately above housing 22 and inclined at an angle such that combustible material placed thereon will be directed onto rear grate section 36 as materials thereon are consumed during combustion. Forward grate section 34 thus not only acts as a fuel provider to the combustion region in fireplace 12, but also, since it is positioned between blower upper housing 22 and the primary area of combustion, acts as a heat shield for the blower and associated components located beneath and within blower upper housing 22.

Forward grate structural members 35 extend rearward from each end of forward grate section 34 and form supports for rear grate section 36 which is positioned thereon. Forward grate section 34 rests on forward grate adjustable supports 38 while forward grate structural members 35 are connected to and rest upon rear grate adjustable supports 40. The lower portions of forward and rear grate adjustable supports 38 and 40 are connected to height positioning screws 44 and 46, respectively. By selectively rotating height positioning screws 44 and 46, the horizontal inclination of the combustion of forward grate section 34 and rear grate section 36 may be adjusted to vary the rate at which combustible materials are provided by forward grate section 34 to rear grate section 36. In addition, the adjustable height of the forward and rear grate sections 34 and 36 permits fireplace heat extractor 10 to be compatible with fireplaces having a sunken hearth. Thus, fireplace heat extractor 10 may be positioned in a fireplace in which the hearth is lower than the hearth outside of the fireplace without decreasing the stability of the heat extractor in the fireplace or degrading the heat transfer characteristics of the heat extractor to the adjacent area.

Once forced air enters plenum 26 through inlet duct aperture 48, it is deflected by means of baffles 50 forward against the front wall 56 of the plenum as shown in FIG. 3, FIG. 4 and FIG. 5. Baffles 50 are positioned on the interior of the plenum's back panel 58 and are shaped so as to deflect the forced air against the plenum's front wall 56 which is immediately adjacent the area of combustion thus enhancing heat exchange. Rear corner seals 68 and side corner seals 70 are incorporated in plenum 26 to eliminate hot air escape from the plenum which would reduce heat extractor efficiency.

After the forced air passes across the front wall 56 of the plenum, it exists plenum 26 via exhaust duct aperture 52 into exhaust duct 28.

A plenum vent 60 is located on the top surface 54 of the plenum and provides an escape route for excessively hot air trapped in plenum 26. Excessively hot air may become confined in plenum 26 and its associated duct work if room air is no longer circulated therein. This could occur if the fireplace is used without blower 72 in operation such as in the event of a power failure or if blower 72 is either inadvertently or intentionally turned off. The exposure of blower 72 and associated components to the hot air thus confined in fireplace heat extractor 10 could result in their severe damage or destruction.

In addition, plenum vent 60 provides a heat escape route when the heat provided to the area immediately adjacent the fireplace is excessive. In this case, turning off blower 72 will cause hot air trapped in plenum 26 to be exhausted through plenum vent 60 and escape via the fireplace's flue. The operation of plenum vent 60, which will be presently explained, thus provides for the thermal protection of system components located in fireplace heat extractor 10 while providing a means to control the heat transferred by convection from the fireplace without extinguishing the fire or even reducing its intensity.

Referring to FIGS. 3 and 4, rotatably mounted on the top surface 54 of plenum 26 is relief door 62 so positioned with respect to plenum vent 60 that the passage of air therethrough is obstructed when relief door 62 is oriented parallel to the plenum's top surface 54. Mounted to the interior surface of back panel 58 is temperature responsive element 64 which is generally formed in the shape of a "J". Element 64 responds to changes in temperature by modifying its shape so as to increase or decrease the spacing between its ends. Variably configured materials such as temperature responsive element 64 are well-known in the art and generally are comprised of a bi-metallic, spring-like material. Temperature responsive element 64 is attached at point "A", preferably by spot welding, to back panel 58 at one end, with its other end in contact with relief door 62, the variable position of which is shown in FIG. 4. Under normal operating conditions, element 64 maintains relief door 62 in position across plenum vent 60.

As the temperature within plenum 26 increases, the curvature of temperature responsive element 64 increases causing the point of contact between relief door 62 and element 64 to move toward point "B" which defines the rotational axis B–B'. This permits relief door 62 to rotate downward thus no longer obstructing plenum vent 60 and allowing excessively hot air to escape from plenum 26. Relief door 62 is supported by means of relief door bracket 63 which is securely mounted to the plenum's back panel 58. In the preferred embodiment of the present invention temperature responsive element 64 is selected such that if the temperature in the upper portion of plenum 26 reaches 375° F. to 400° F., temperature responsive element 64 begins to assume a more exaggerated bent configuration permitting relief door 62 to become displaced from in front of plenum vent 60, with plenum vent 60 fully opened when the air temperature within the plenum reaches 500° F. This relief valve opening action not only releases the excessively hot, trapped air within plenum 26, but permits a continuous flow of ambient temperature air to enter inlet 20, pass through blower upper housing 22 thus cooling components therein, and escape from plenum 26 via plenum vent 60. A spark guard 66 is positioned on the plenum's top surface 54 so as to cover plenum vent 60. Spark guard 66 thus prevents hot debris produced during combustion from entering plenum 26 while permitting the free flow of hot air through plenum vent 60 when permitted by relief door 60.

The details of blower housing are shown in FIG. 6. Blower 72 is positioned on mounting plate 74 which is positioned in and rests upon heat shield bottom plate 76. Positioned over heat shield bottom plate 76 so as to enclose blower 72 is blower upper housing 22. Upper housing 22, mounting plate 74 and heat shield bottom plate 76 are mutually connected by conventional means as shown in FIG. 6. Mounted on the forward portion of mounting plate 74 and heat shield bottom plate 76 is air inlet lower housing 80 which is combination with air inlet upper housing 78 defines air inlet 20. Air inlet 20 is provided with one or more louvers **20*a* for controlling air flow direction. Inlet lower housing 80 is provided with an aperture 88 through which electrical lead 82 is passed for electrically coupling plug assembly 84 with blower 72. Plug assembly 84 may be connected to any conventional AC outlet for energizing blower 72. The output of blower 72 is provided to inlet duct 24 via an aperture defined by the rear portions of blower upper housing 22 and heat shield bottom plate 76**.

Referring to FIG. 7, a telescoping exhaust duct 28 is shown coupled to exhaust housing 30 for providing the forced air flow to air outlet 32 in exiting fireplace heat extractor 10. In the preferred embodiment of the present invention, both inlet and outlet ducts are of a telescoping nature as shown in FIG. 7 to permit fireplace heat extractor 10 to be compatible with a wide variety of fireplace depth dimensions. Located in exhaust duct 28 is an air flow control valve 86 which is responsive to the blower-generated air flow in that it is in the open position when blower 72 is operating but reverts to the closed position when blower 72 is off. Air flow control valve 86 thus allows air to freely circulate through fireplace heat extractor 10 by the action of blower 72, but does not allow warm room air to be drawn into heat extractor 10 to be vented via plenum vent 60 due to "chimney effect" when blower 72 is inoperative and plenum vent 60 is open. In the preferred embodiment of the present invention air flow control valve 86 is a flat plate rotatably mounted on the upper, inner surface of exhaust duct 28 free to move in only one direction of rotation relative to the vertical.

There has thus been described a highly efficient, safe and reliable forced-air heat extraction system which may be positioned entirely within a conventional fireplace.

While particular embodiments of the present invention have been shown and described, it will be apparent to those skilled in the art that changes and modifications may be made therein without departing from the invention in its broader aspects. The aim of the appended claims, therefore, is to cover all such changes and modifications as fall within the true spirit and scope of the invention.

We claim:

1. A forced-air heat extraction system for use in a conventional fireplace, said system comprising:

a bottom bar adapted to be positioned at the lower forward portion of said fireplace, said bottom bar having an air inlet and an air outlet;

plenum means adapted to be positioned at the rear of said fireplace and having a forward heat exchange wall;

an inlet duct providing a housing and coupling said air inlet to said plenum in air flow relation;

electrically energized air circulating means located in said housing, for forcing room air from said inlet through said inlet duct into said plenum and across said heat exchange wall;

grate means positioned adjacent a front surface of said plenum for supporting combustible materials thereon, said grate means including;

a first section located immediately adjacent the front surface of said plenum and upon which combustion primarily occurs;

and a second solid section located immediately adjacent said first section such that said first section is positioned between said second section and said plenum means, said second solid section oriented at an inclined angle, so as to cause combustible materials placed thereon to be re-positioned on said first section as materials thereon are consumed during combustion;

an outlet duct coupling said plenum to said air outlet for providing air heated in said plenum to the space adjacent said fireplace; and temperature responsive means positioned in the upper portion of said plenum for venting the hot air in said plenum directly into a chimney stack when the temperature of the air therein exceeds a predetermined value.

2. A system as in claim 1 wherein said temperature responsive means includes an aperture, plate means movably positioned adjacent said aperture, and temperature sensitive means mounted to the interior of said plenum and operatively coupled to said plate means so as to position said plate means in front of said aperture when the temperature in said plenum does not exceed said predetermined value and to remove said plate means from said aperture when the temperature in said plenum exceeds said predetermined value.

3. A system as in claim 2 wherein said temperature sensitive means comprises a bi-metallic element the shape of which is determined by the temperature in said plenum.

4. A system as in claim 1 further comprising air flow control means in said outlet duct responsive to air flow provided by said air circulating means such that said outlet duct is open when said air circulating means is operating and closed when said air circulating means is not operating.

5. A system as in claim 4 wherein said air flow control means includes plate means rotatably coupled to an upper interior surface of said outlet duct so as to obstruct the movement of air therethrough when said plate means is not maintained in a deflected position by the air flow provided by said air circulating means.

6. A system as in claim 1 wherein said grate means further includes a plurality of structural members coupled to the first section of said grate means immediately adjacent to the front surface of said plenum and in generally parallel displacement therefrom for enhanced air flow across the front surface of said plenum.

7. A system as in claim 1 wherein said second solid section of said grate means is positioned above said housing so as to provide a thermal barrier for said air circulating means.

8. A system as in claim 1 wherein said inlet and outlet ducts are of variable length thus permitting said plenum to be variably positioned relative to the front of said fireplace.

9. A system as in claim 1 wherein said bottom bar is of variable length.

10. A system as in claim 1 wherein said grate means is positioned on variable length support means to permit said heat extraction system to be installed in a sunken hearth fireplace while maintaining the position of said combustible materials immediately adjacent the front surface of said plenum.

11. A forced-air heat extraction system for use in a conventional fireplace, said system comprising:

a bottom bar adapted to be positioned at the lower forward portion of said fireplace, said bottom bar having an air inlet and an air outlet;

plenum means adapted to be positioned at the rear of said fireplace and having a forward heat exchange wall;

an inlet duct providing a housing and coupling said air inlet to said plenum in air flow relation;

electrically energized air circulating means located in said housing, for forcing room air from said inlet through said inlet duct into said plenum and across said heat exchange wall;

grate means positioned adjacent a front surface of said plenum for supporting combustible materials thereon, said grate means including;

a first section located immediately adjacent the front surface of said plenum and upon which combustion primarily occurs; and a second solid section located immediately adjacent said first section such that said first section is positioned between said second section and said plenum means, said second solid section oriented at an inclined angle, so as to cause combustible materials placed thereon to be re-positioned on said first section as materials thereon are consumed during combustion;

an outlet duct coupling said plenum to said air outlet for providing air heated in said plenum to the space adjacent said fireplace;

temperature responsive means including an aperture, plate means movably positioned adjacent said aperture, and temperature sensitive means mounted to the interior of said plenum and operatively coupled to said plate means so as to position said plate means in front of said aperture when the temperature in said plenum does not exceed a predetermined value and to remove said plate means from said aperture when the temperature in said plenum exceeds said predetermined value; and air flow control means in said outlet duct responsive to air flow provided by said air circulating means such that said outlet duct is open when said air circulating means is operating and closed when said air circulating means is not operating.

12. A forced-air heat extraction system for use in a conventional fireplace, said system comprising:

a bottom bar adapted to be positioned at the lower forward portion of said fireplace, said bottom bar having an air inlet and an air outlet;

plenum means adapted to be positioned at the rear of said fireplace and having a forward heat exchange wall;

an inlet duct providing a housing and coupling said air inlet to said plenum in air flow relation;

electrically energized air circulating means located in said housing, for forcing room air from said inlet through said inlet duct into said plenum and across said heat exchange wall;

grate means positioned adjacent a front surface of said plenum for supporting combustible materials thereon, said grate means including:

a first section located immediately adjacent the front surface of said plenum and upon which combustion primarily occurs; and a second solid section located immediately adjacent said first section and above said housing so as to provide a thermal barrier for said air circulating means, said second section resting upon a plurality of variable length support means by means of which the inclination of said second grate section and the relative position of the combustible materials with respect to said plenum may be varied;

an outlet duct coupling said plenum to said air outlet for providing air heated in said plenum to the space adjacent said fireplace;

temperature responsive means including an aperture, plate means movably positioned adjacent said aperture, and temperature sensitive means mounted to the interior of said plenum and operatively coupled to said plate means so as to position said plate means in front of said aperture when the temperature in said plenum does not exceed a predetermined value and to remove said plate means from said aperture when the temperature in said plenum exceeds said predetermined value; and air flow control means in said outlet duct responsive to air flow provided by said air circulating means such that said outlet duct is open when said air circulating means is operating and closed when said air circulating means is not operating.

13. A forced-air heat extraction system for use in a conventional fireplace, said system comprising:

a bottom bar adapted to be positioned at the lower forward portion of said fireplace, said bottom bar having an air inlet and an air outlet;

plenum means adapted to be positioned at the rear of said fireplace and having a forward heat exchange wall;

an inlet duct providing a housing and coupling said air inlet to said plenum in air flow relation;

electrically energized air circulating means located in said housing, for forcing room air from said inlet through said inlet duct into said plenum and across said heat exchange wall;

grate means positioned adjacent a front surface of said plenum for supporting combustible materials thereon, said grate means including:

a first section located immediately adjacent the front surface of said plenum and upon which combustion primarily occurs, said first grate section having a plurality of structural members proximately located with respect to said plenum's front surface and in generally parallel displacement therefrom for enhanced air flow across the front surface of said plenum; and a second solid section located immediately adjacent said first section and above said housing so as to provide a thermal barrier for said air circulating means, said second section resting upon a plurality of variable length support means by means of which the inclination of said second grate section and the relative position of the combustible materials with respect to said plenum may be varied;

an outlet duct coupling said plenum to said air outlet for providing air heated in said plenum to the space adjacent said fireplace;

temperature responsive means including an aperture, plate means movably positioned adjacent said aperture, and temperature sensitive means mounted to the interior of said plenum and operatively coupled to said plate means so as to position said plate means in front of said aperture when the temperature in said plenum does not exceed a predetermined value and to remove said plate means from said aperture when the temperature in said plenum exceeds said predetermined value; and air flow control means in said outlet duct responsive to air flow provided by said air circulating means such that said outlet duct is open when said air circulating means is operating and closed when said air circulating means is not operating.

14. A forced-air heat extraction system for use in a conventional fireplace, said system comprising:

a bottom bar positioned at the lower forward portion of said fireplace, said bottom bar having an air inlet and an air outlet in air flow communication with a room to be heated;

a plenum located in the rear of said fireplace beneath a stack;

inlet duct means communicating said air inlet with said plenum;

outlet duct means communicating said air outlet with said plenum;

housing means in one of said ducts;

electrically energized air circulating means located in said housing means, said housing means coupling said air inlet to said inlet duct for forcing room air through said inlet, said air inlet duct means, said plenum, said outlet duct means and back into said room through said air outlet;

and temperature responsive means positioned adjacent the upper portion of said plenum for venting hot air in said plenum into said stack when the temperature of the air therein exceeds a predetermined value.

15. A system as in claim 14 wherein said temperature responsive means includes an aperture, plate means movably positioned adjacent said aperture, and temperature sensitive means mounted to the interior of said plenum and operatively coupled to said plate means so as to position said plate means in front of said aperture when the temperature in said plenum does not exceed a predetermind value and to remove said plate means from said aperture when the temperature in said plenum exceeds said predetermined value.

16. A system as in claim 15 further comprising air flow control means in said outlet duct responsive to air flow provided by said air circulating means such that said outlet duct is open when said air circulating means is operating and closed when said air circulating means is not operating.

17. The apparatus of claim 14 wherein said plenum comprises a generally horizontal top wall defining an aperture, said temperature responsive means comprising a closure member pivotally mounted on said plenum for movement between a first position in which said closure member covers said aperture in flow sealing relation and a second position in which said closure member is displaced from said aperture to permit the free flow of air from said plenum into said stack; and a temperature responsive element urging said closure member to said first position at a normal operating temperature and urging said closure member to said second position above a predetermined temperature.

18. The apparatus of claim 17 wherein said closure means in said first position engages the lower surface of said top wall and is adapted to fall away from said top wall under gravity in the event said temperature responsive element becomes detached from said plenum or from said closure member.

19. A forced-air heat extraction system for use in a conventional fireplace having a radiating-type firescreen, said system comprising:

a bottom bar adapted to be positioned at the lower forward portion of said fireplace beneath said firescreen, said bottom bar having an air inlet and an air outlet;

plenum means adapted to be positioned at the rear of said fireplace and having a forward heat exchange wall;

an inlet duct providing a housing and coupling said air inlet to said plenum in air flow relation;

electrically energized air circulating means located in said housing, for forcing room air from said inlet through said inlet duct into said plenum and across said heat exchange wall;

grate means positioned adjacent a front surface of said plenum for supporting combustible materials thereon, said grate means including:

a first section located immediately adjacent the front surface of said plenum and upon which combustion primarily occurs;

and a second solid section located immediately adjacent said first section such that said first section is positioned between said second section and said plenum means, said second solid section oriented at an inclined angle, so as to cause combustible materials placed thereon to be re-positioned on said first section as materials thereon are consumed during combustion;

and outlet duct coupling said plenum to said air outlet for providing air heated in said plenum to the space adjacent said fireplace; and temperature responsive means positioned in the upper portion of said plenum for venting the hot air in said plenum directly into a chimney stack when the temperature of the air therein exceeds a predetermined value.

20. A forced-air heat extraction system for use in a conventional fireplace having a radiating-type firescreen, said system comprising:

a bottom bar positioned at the lower forward portion of said fireplace and beneath said firescreen, said bottom bar having an air inlet and an air outlet in air flow communication with a room to be heated;

a plenum located in the rear of said fireplace beneath a stack;

inlet duct means communicating said air inlet with said plenum;

outlet duct means communicating said air outlet with said plenum;

housing means in one of said ducts;

electrically energized air circulating means located in said housing means, said housing means coupling said air inlet to said inlet duct for forcing room air through said inlet, said air inlet duct means, said plenum, said outlet duct means and back into said room through said air outlet;

and temperature responsive means positioned adjacent the upper portion of said plenum for venting hot air in said plenum into said stack when the temperature of the air therein exceeds a predetermined value.

* * * * *